United States Patent [19]

Klygis

[11] 4,099,616

[45] Jul. 11, 1978

[54] TWO-BOTTLE PACKAGE AND BAG

[75] Inventor: Julius Mindaugas Klygis, Barrington, Ill.

[73] Assignee: Illinois Tool Works Inc., Chicago, Ill.

[21] Appl. No.: 787,420

[22] Filed: Apr. 14, 1977

[51] Int. Cl.[2] ..... B65D 71/00; B65D 85/62

[52] U.S. Cl. ..... 206/427; 229/62

[58] Field of Search ..... 206/427, 45.33, 497, 206/434; 229/54 R, 62, DIG. 12; 150/1.7, 3

[56] References Cited

U.S. PATENT DOCUMENTS

| | | | |
|---|---|---|---|
| 3,358,904 | 12/1967 | Van Houtte | 229/54 R |
| 3,460,863 | 8/1969 | Schaich | 206/427 |
| 3,482,761 | 12/1969 | Suominen et al. | 150/1.7 |
| 3,961,743 | 6/1976 | Hollowell | 229/62 |

*Primary Examiner*—William T. Dixson, Jr.
*Attorney, Agent, or Firm*—Edward L. Benno; Robert W. Beart

[57] ABSTRACT

A package of and a bag for two bottles. The bag is made from an unsupported and unreinforced thin plastic material that is substantially incapable of safely supporting the weight load of the bottles from a single thickness area of the bag material. In the package the bag has two substantially stretched and tensioned areas. One of the areas is a band about the body portion of the bottles. The other area is a band that includes gathered and secured material, part of which is a handle. The two stretched and tensioned band areas of the bag cooperate together and with the bottles to firmly hold the bottles together and enable the weight load of the bottles to be safely and securely carried from the handle.

3 Claims, 8 Drawing Figures

TWO-BOTTLE PACKAGE AND BAG

BACKGROUND OF THE INVENTION

Particularly in the beverage industry, various beverages are being packaged in increasingly larger bottles. Two common sizes currently being distributed in the marketplace are 64 oz. and 1 liter bottles. Such bottles when filled with a beverage are relatively heavy, for example in the area of four and a half pounds per filled bottle, and present substantial problems when attempts are made to multipackage such bottles with economical packaging materials. The packaging problems are complicated by the necessary handling that occurs from the beverage plant to the eventual consumer. After filling and multipackaging, the packages must withstand the rigors of shipment, commonly by truck, storage, and handling through retail distribution channels to the shelves or racks of a retail store. From the retail store the package must have sufficient integrity and strength to firmly and safely hold the rather heavy bottles as they are picked up by a store customer and carried and handled in various ways from the store to the purchaser's place of use.

The most common presently used package for such bottles is a package made of paperboard generally in a basket form. Paperboard baskets can be made substantially strong to safely carry the weight load of a plurality of such bottles. However, there are at least two noteworthy disadvantages to such paperboard baskets. Firstly, they are relatively high in cost and in many instances uneconomical as a one-way package for nonreturnable bottles. Secondly, by rather loosely carrying the bottles, the bottles are subject to movement and vibration during normal transport procedures with the undesirable result that the generally highly decorated bottles are abraded to substantially detract from the esthetic impression of the bottles.

SUMMARY OF THE INVENTION

The subject invention represents a unique solution to the noted disadvantages of paperboard baskets for relatively large-sized beverage bottles. The bag and package of the subject invention is considerably lower in cost than known paperboard baskets of substantially the same weight carrying capabilities, and the bottles are substantially enveloped by the bag and firmly held together in a fixed relationship to protect the bottles and to substantially prevent abrasion of highly decorative bottles in normal transport.

The package of the invention involves two bottles that are enveloped by a bag that is made from an unsupported and unreinforced thin plastic material that is substantially incapable of safely supporting the weight load of the bottles from a single thickness area of the bag material. A safe secure package of the two bottles is provided by the combination and cooperation of particular band areas of the bag with each other, with the bottles, and with the handling and carrying arrangement of the package.

There are essentially three cooperating band areas of the bag and the package, with the first being a circumferentially continuous band area that extends about the body portions of both of the bottles with that band area being in a stretched condition in a direction circumferentially about both of said bottles in planes perpendicular to the longitudinal axes of the bottles. That circumferentially stretched condition of the first bag area is sufficiently to firmly hold the two bottles together in an upstanding side-by-side relationship with a broad surface area of gripping contact between the band and the body portions of the bottles. The second band area may be described as shaped as an inverted U-shape with the legs of the "U" connected to the upper edges of the circumferential band portion and with the horizontal crosspiece of the "U" being split and extending between the bottles at a position below and on each side of the cap portions of the bottles. The second band area is also in a stretched and tensioned condition and is further gathered and secured substantially to a point midway between the necks of the bottles below the caps. The second band area of the bag has an initial width greater than one-half of the diameter of the body portions of the bottles to provide sufficient material for carrying the weight load of the bottles when a person carries the package by encircling the gathered secured area with one or more fingers and allows the package to depend or hang from his fingers.

The bag and the package further comprises a third or bottom band area. In reductions to practice of the invention it appears that the bottom band is one of minimum stretch and tension relative to the first and second areas both in the at rest condition of the package upon some surface and also when the package is being carried by a person grasping the upper center gathered and secured portion of the bag. The bottom band portion of the bag is connected between the lower edges of two opposed sides of the first band area.

The primary object of the invention is to provide a two-bottle package and a bag forming the package for relatively heavy bottles with the bag being made from an unsupported and unreinforced thin plastic material that is substantially incapable of safely supporting the weight load of the bottles from a single thickness area of the bag.

Other objects and features of the invention will be apparent upon a perusal of the hereinafter following detailed description read in conjunction with the drawings.

DETAILED DESCRIPTION OF THE PREFERRED EMBODIMENT

Figure 1:
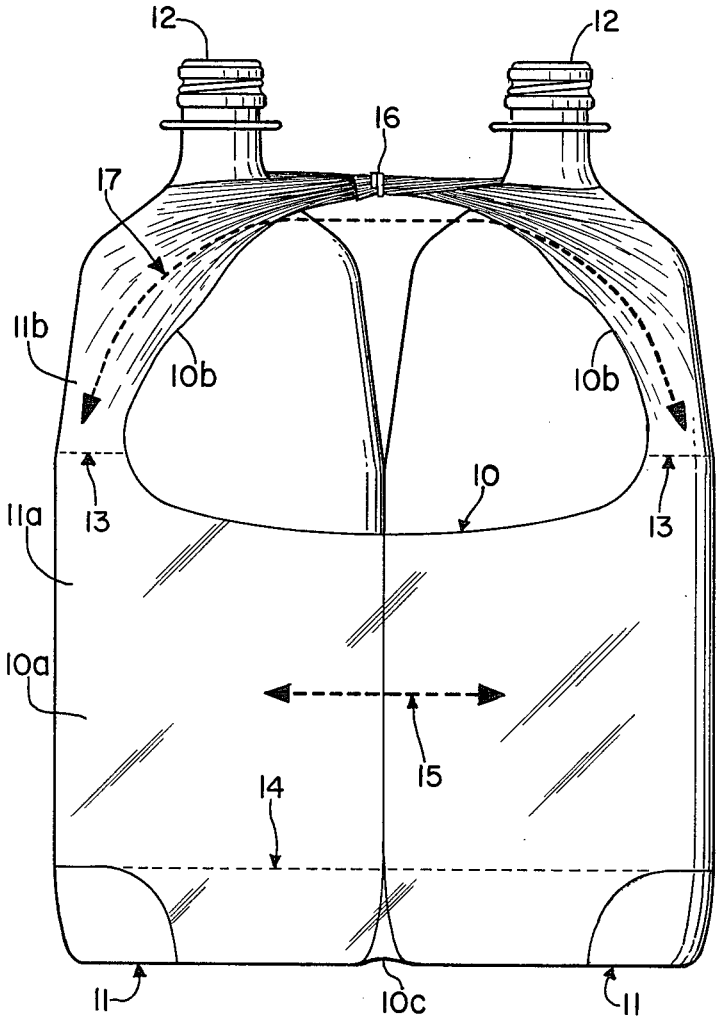
FIG. 1 is a side elevational view of one embodiment of a package made according to the invention.

In the first embodiment shown in FIGS. 1 - 5 the package comprises a bag 10 and two bottles 11.

The bottles 11 are preferably a substantially large beverage bottle such as known in the art as the 64 oz. and the 1 liter sizes. The shape of the preferred bottles is such as to have a substantially cylindrical body portion 11*a* and an inwardly and upwardly tapering neck portion 11*b* surmounted by a reduced diameter cap portion 12. The particular degree of taper and bottle configuration shown is not critical, except that changes in length and width of the cooperating portions of the bag 10 may have to be made for other bottle configurations. Further, the bottles may be made of glass or of a plastics material. Because of the substantial enveloping condition of the bag about the bottles 11, substantial containment protection is afforded for beverage bottles wherein the contents are pressurized.

The bag 10 is formed from an unsupported and unreinforced thin plastic material that is substantially incapable of safely supporting the weight load of the bottles from a single thickness area of the bag. In reductions to practice of the invention it has been found that one suitable film material for two 64 oz. beverage bottles is low-density polyethylene film material of a material thickness of about 3 mils. The bag 10 is made so that in the applied and completed condition of the package, two band areas of the bag are in a substantially stretched and tensioned condition in the at rest and carried conditions of the package. The first band area is a circumferential band 10*a* that extends about the body portion 11*a* of both of the bottles and is generally between the dotted lines 13 and 14 shown in FIGS. 1 and 2. The band 10*a* is stretched and tensioned circumferentially about the bottles 11 in the direction indicated by the double-headed arrow 15 in FIGS. 1 and 2. In the preferred form, the band 10*a* has a height sufficient to substantially span the body portions 11*a* of the bottles 11.

The second stretched and tensioned band area of the bag 10 in the package comprises, in the embodiment of FIGS. 1 - 5, a pair of bifurcated band sections 10*b*. Each of the band sections 10*b* has a base portion integrally connected to the upper edge of the band 10*a* substantially along the dotted line 13 indicated in FIGS. 1 and 2. Further, the band sections 10*b* are disposed at opposed side edges of the band 10*a* to include the neck portions of the bottles 11 there-between as may be seen in FIGS. 1 - 3. The band sections 10*b* further have a width measured circumferentially of the bottles greater than one-half of the diameter of the body portions of the bottles 11 to provide for a substantial load carrying capability of the band sections 10*b*. The bifurcated segments of each of the band sections 10*b* are disposed on each side of the reduced neck portion of one of the bottles 11 and gathered together substantially to a point at a position midway between the necks of the bottles 11. The opposed band sections 10*b* are stretched and secured together under tension at the point of maximum gathering, a position substantially midway between the necks of the bottles 11*b*, by some known fastening means such as the clamped metal C-ring shown in FIGS. 1 and 3. In that stretched, tensioned, and secured condition the second band area may be described as stretched and tensioned along inverted U-shaped lines such as shown by the double-headed U-shaped arrow lines 17 shown in FIGS. 1 and 2.

Figure 2:
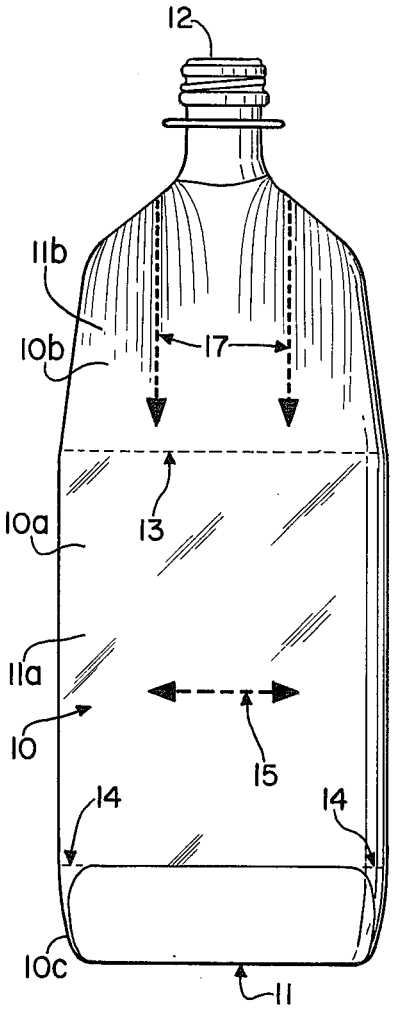
FIG. 2 is an end elevational view of the package shown in FIG. 1.

The third or bottom band area of the bag 10 is shown at 10*c* in FIGS. 1 and 2. The bottom band area 10*c* is integrally connected between two opposed sides of the lower edge of the band area 10*a* substantially along the dotted line 14 indicated in FIGS. 1 and 2. Preferably the bottom band area 10*c* is connected to the first band area 10*a* along the lower edge thereof between the circumferential areas that are circumferentially displaced from the dotted lines 13, or in other words, that are not below the segments of the first band area 10*a* to which the band sections 10*b* are connected. The bottom band area 10*c* in the completed package is an area of minimum stretch and tension relative to the noted stretched and tensioned areas of the first and second band areas 10*a* and 10*b*.

Figure 3:
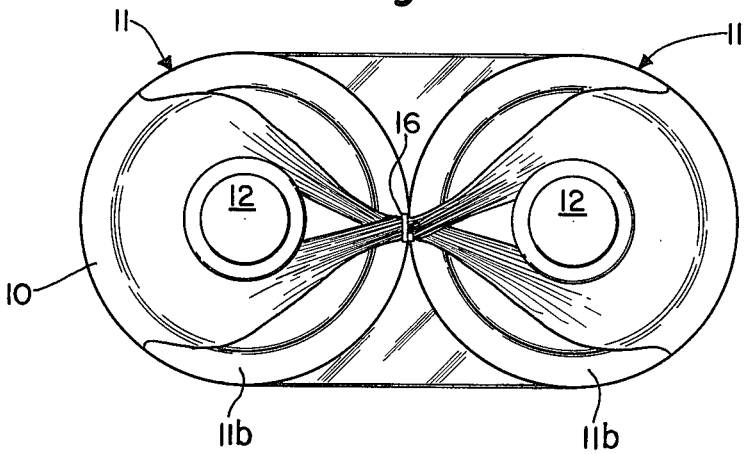
FIG. 3 is a top plan view of the package shown in FIG. 1.
Figure 4:
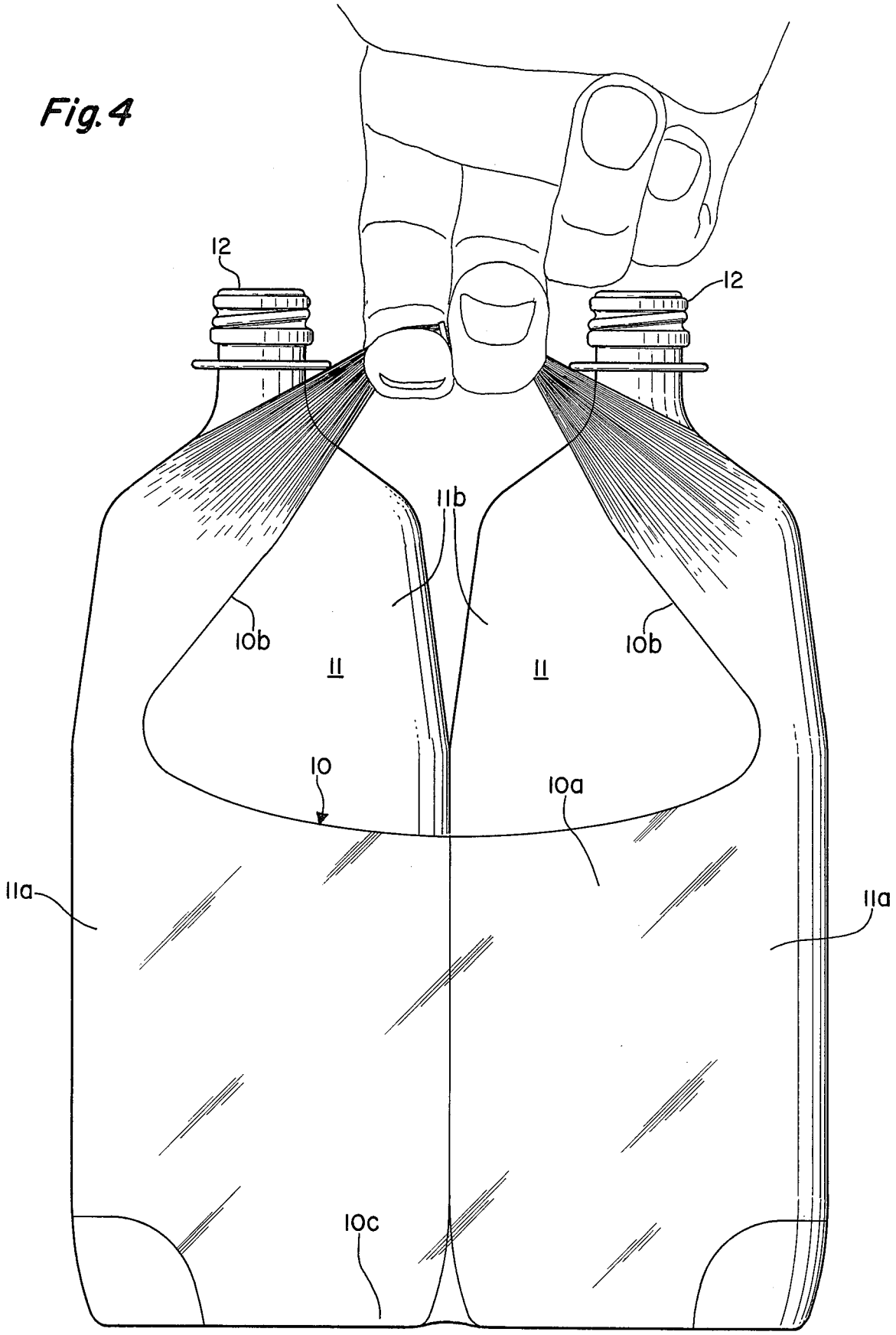
FIG. 4 is an enlarged side elevational view showing a person carrying the package.

In reductions to practice of the invention in accordance with the first described embodiment, it has been found that the package as shown in FIGS. 1 - 3 satisfies standard commercial shipping tests for such packages and further, that the package may be carried by a person as shown in FIG. 4 with the bottles in a hanging or depending condition, and that in that carried condition the bag material will not tear under the load weight of the bottles and the bottles in the package may be safely carried from a store to a place of use.

Figure 5:
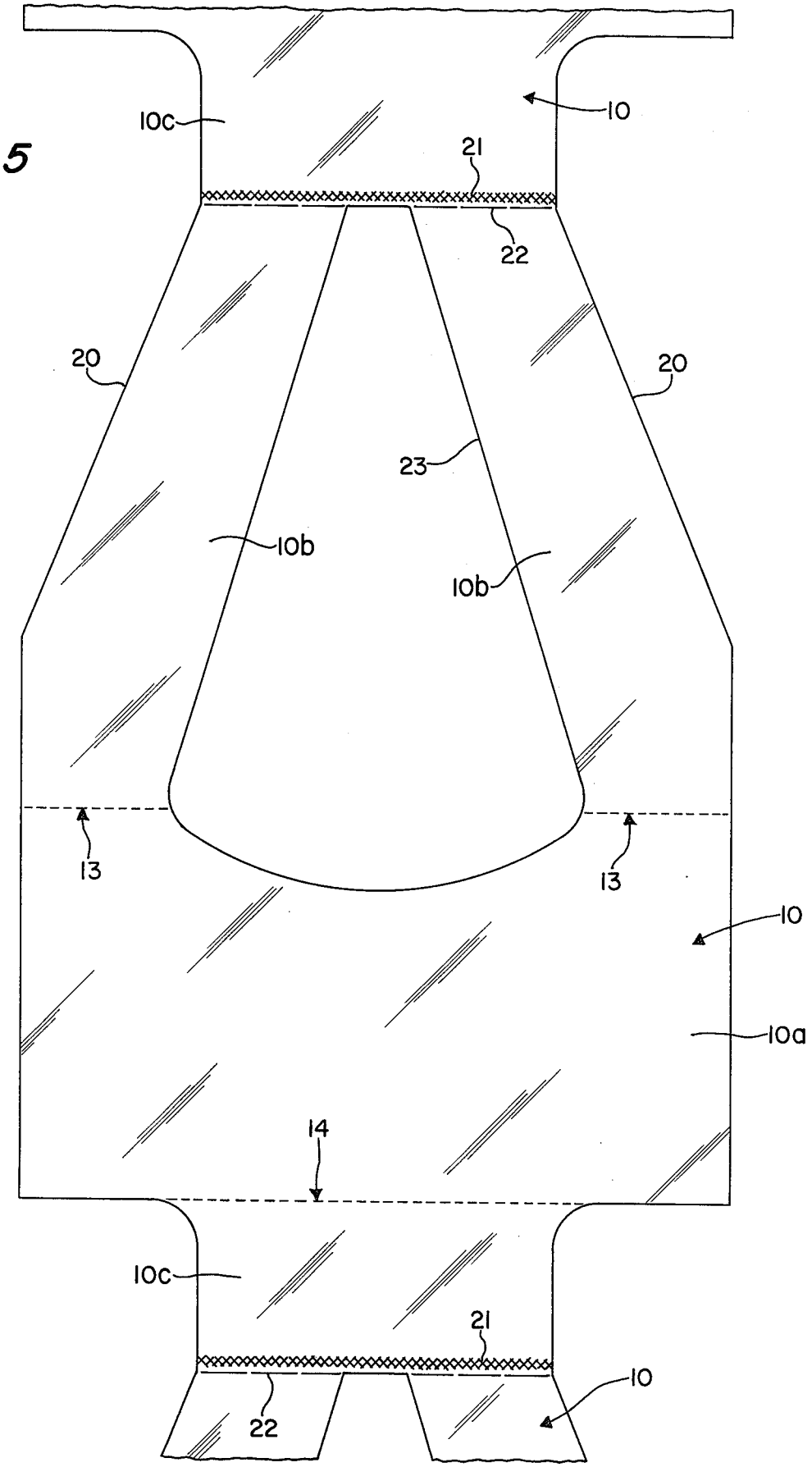
FIG. 5 is a plan view of a portion of a connected series of bags of the package of FIGS. 1 - 3.

In its initial condition the bag 10 is configured substantially as shown in FIG. 5. Conveniently, a plurality of bags 10 may be made from a tubular film material that is flattened and cut or punched to produce the configuration shown. In that configuration the first band area 10*a* is shown between the dotted lines 13 and 14. In FIG. 5 the bifurcated segments of the second band sections 10*b* are formed by cutting away the tubular stock material along the lines 20. The ends of the bifurcated segments are initially connected to bottom band portion 10*c* of an adjacent bag 10 formed from the tubular stock material. A convenient method of manufacture is to provide a line of heat sealing 21 between the two layers of a bottom band portion 10*c* with a weakened tear line 22 formed immediately below the heat seal line 21. Thus, it may be seen that when one bag 10 in the strip is pulled from the next adjacent band, the bifurcated segments of the second band portion 10*b* will be pulled free from the heat-sealed line 21 along weakened tear line 22. The open area between the second band sections 10*b* and above the first band area 10*a* is formed by punching or cutting out both layers of the tubular stock material along the line 23 as shown in FIG. 5.

Advantageously, the bifurcated segments of the second band areas 11*b* are longer than the effective lengths of those bifurcated band segments in the completed package shown in FIGS. 1 - 4 to conveniently permit an overlapping of the ends in the stretching, tensioning and securement with the C-shaped clamp 16. In the completed package, excess overlapped material may be trimmed close to the C-shaped clamp 16 if desired for esthetic reasons.

Figure 6:
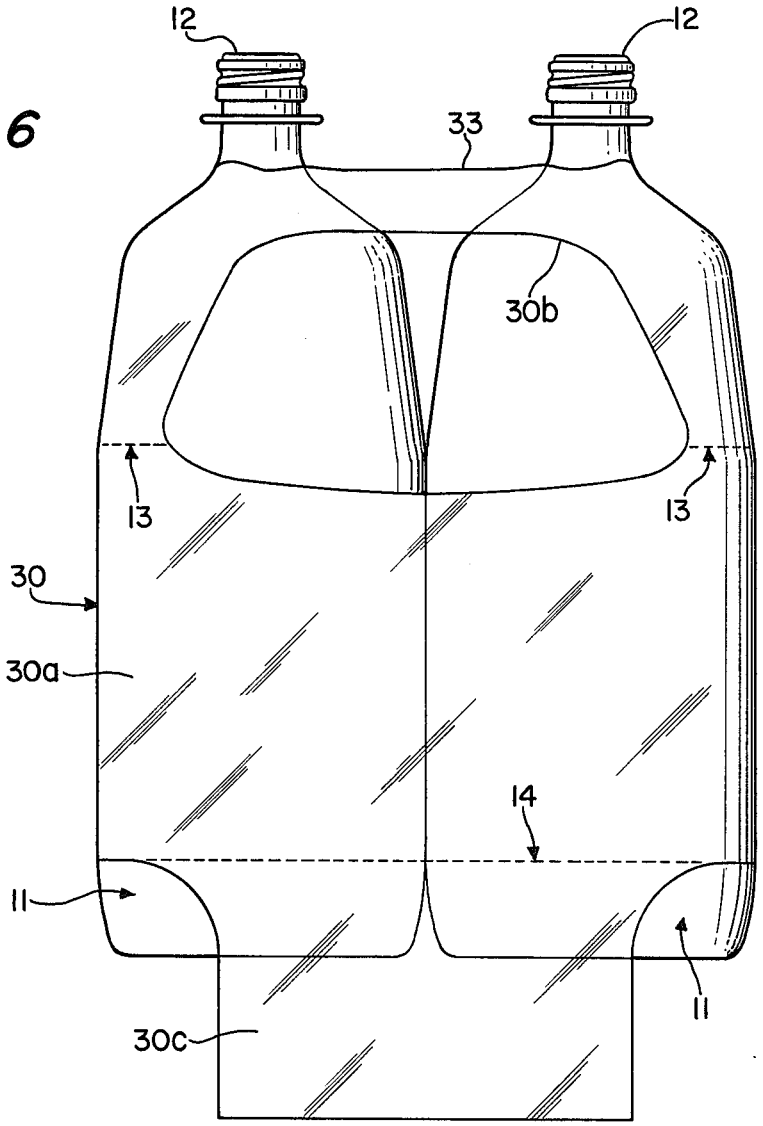
FIG. 6 is a side elevational view of a partially completed package of another embodiment of the invention.
Figure 7:
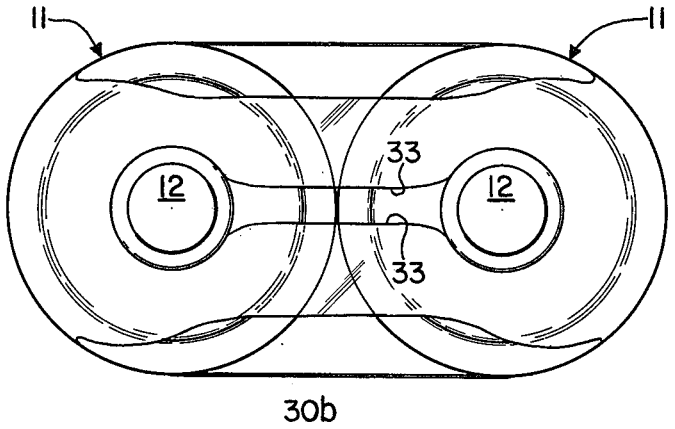
FIG. 7 is a top plan view of the package shown in FIG. 6.
Figure 8:
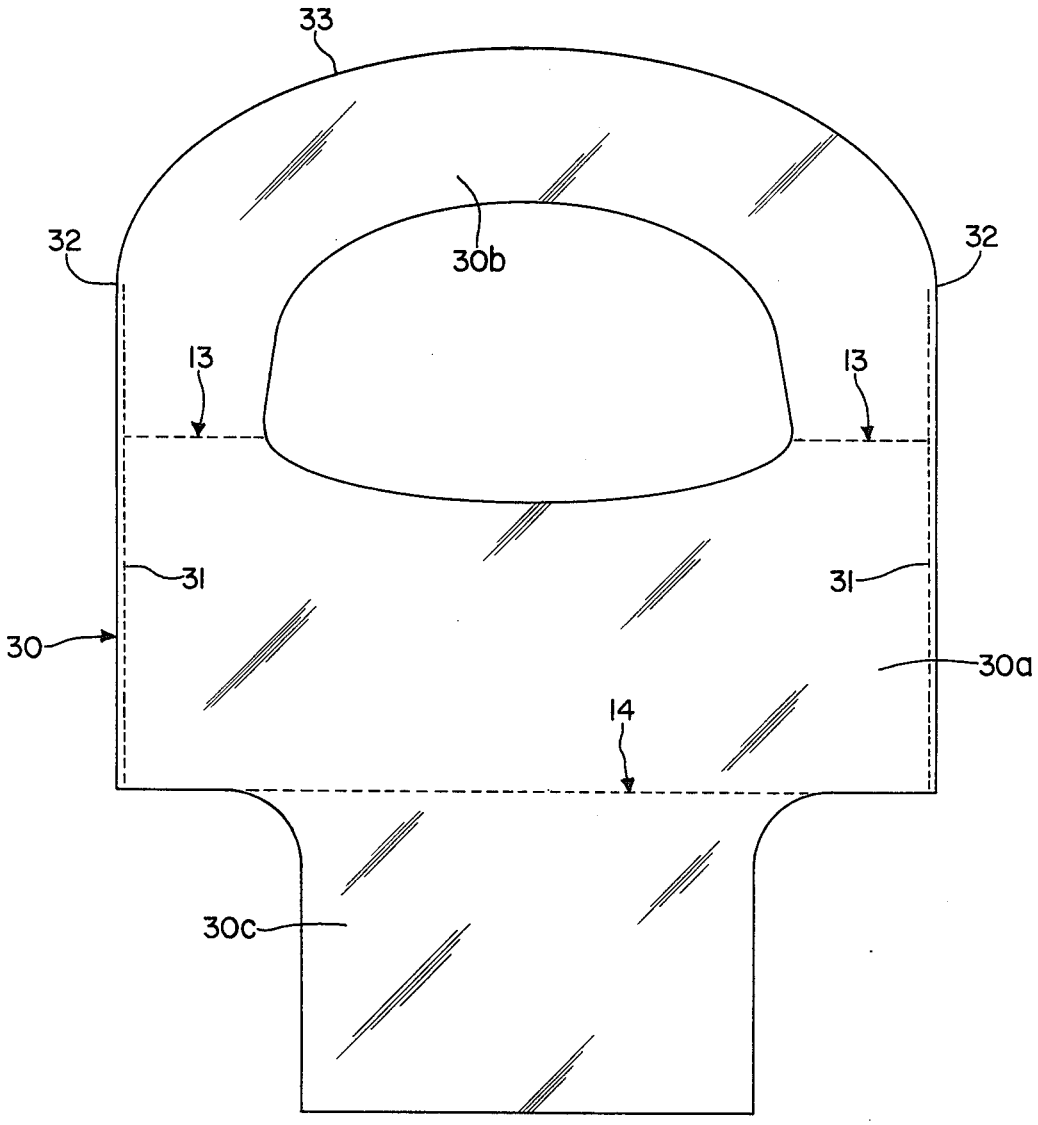
FIG. 8 is a plan view of the bag of the package of FIGS. 6 and 7 in an initial flat unmounted condition.

FIGS. 6, 7 and 8 show another embodiment of the invention and particularly contemplate a bag 30 shaped as shown in FIG. 8. In that embodiment, the first band area 30*a* is formed in two layers of a punched or cut lay-flat tubular stock extending between the fold lines at the dotted lines shown at 31 and further between the dotted lines 13 and 14 shown in FIG. 8. The second band sections 30*b* are formed as two identical layers of the tubular stock joined to the upper edge of the first band area 30*a* along the dotted lines 13. The two layers of the second band section 30*b* are further joined along the fold line indicated by the dotted line 31 which at its upper end terminates at points 32 so that the upper portion of the second band section 30*b* may be described as open or slotted along the line 33 extending between the two points indicated at 32 as shown in FIG. 8.

FIG. 8 further shows the bottom band portion 30*c* as two layered flaps, each of which is connected to the lower edge of the first band area 30a along the dotted line 14.

In assembling the package of the second embodiment of the invention, the bottles 11 are inserted into the bag 30 from the open bottom end thereof to produce the partially completed package shown in FIGS. 6 and 7. In the partially completed bag arrangement shown in FIGS. 6 and 7, it may be seen that as in the first embodiment of the invention, the first band area 30a encircles the body portions of both of the bottles and the second band area 30b extends in the previously described inverted U-shape over the neck portions of the bottles 11 and therebetween with the line 33 at the upper edge of the bag 30 extending about the reduced neck portions of the bottles 11 immediately below the cap portions 12 of the bottles 11.

After the bag 30 has been firmly applied to the bottles 11 as shown in FIGS. 6 and 7, the depending flaps of the bottom wall area 30c may be brought together beneath the bottles 11 and heat sealed together. Thereafter, any undesirable excess material may be trimmed therefrom. Alternatively, the flaps of the bottom band portion 30c may merely be overlapped and adhesively secured together to form the completed bottom band portion 30c.

The bifurcated joined segments of the second band area 30b, which in the embodiment of FIGS. 6 and 7 encircle the line 33, are then gathered together and secured by a known fastener such as the C-shaped clamp 16 of the first embodiment at a position substantially midway between the neck portions of the bottles 11. That final securement step aids in further stretching and tensioning the second band area 30b and in the completed condition, the top of the package will be substantially identical to the view of the first embodiment of the invention shown in FIG. 3.

In the completed condition of the package in the embodiment of FIGS. 6 – 8, substantially the same stretched and tensioned areas are produced as in the first embodiment to result in a package substantially equal in operation and result to the operations and results of the package of the first described embodiment.

Having described the invention it should be understood that changes can be made in the described embodiments by one skilled in the art within the spirit and scope of the claims.

I claim:

1. A package of two bottles comprising, a bag substantially enveloping two bottles in an upstanding side-by-side abutting relationship, said bag formed of a resilient elastic plastic material and comprising a band portion encircling a substantial vertical extent of the body portions of both of said bottles and substantially tensioned horizontally circumferentially about the body portions of both of said bottles, a bottom wall connected to the lower edges of at least two opposed sections of said band portion and extending beneath a substantial portion of the bottom walls of both of said bottles, a pair of upper wall portions, each of said upper wall portions comprising a bifurcated member of two strips integrally joined to a common base section, the common base section of said bifurcated members integrally connected to opposed sections of the upper edge of said band portion, the two strips of each bifurcated member straddling the upper neck portion of one of said bottles beneath the cap portion thereof, and the two strips of both of said bifurcated members being secured together and gathered substantially to a point substantially midway between the upper neck portions of said bottles sufficiently to substantially tension said bifurcated members between said point and said band portion.

2. In a package of two bottles each of which has a body portion and a neck portion tapered to a small diameter cap portion and a bag substantially enveloping said two bottles to hold said bottles together in an upstanding side-by-side relationship with the body portions of said bottles in firm abutment and to permit said package to be carried by the top central portion of the bag with said bottles depending therefrom, the improvement of said bag formed of a resilient elastic plastic sheet material of a thickness such that the material is subject to tearing when the weight of said bottles is supported from a single thickness limited area of the sheet material, said bag comprising a plurality of band areas integrally interconnected and arranged to cooperatively permit said package to be carried by the top central portion of the bag with said bottles depending therefrom and substantially absent any tearing tendency of said sheet material under the depending weight of said bottles on said material of said bag, one of said plurality of band areas comprising said sheet material stretched and tensioned horizontally circumferentially in a band about the body portions of both of said bottles, a second of said band areas comprising said sheet material in a band extending beneath said bottles between at least two opposed edges of the lower edge of said one of said plurality of band areas, a third of said band areas comprising two band sections connected to the upper edges of said one of said plurality of band areas with each of said band sections extending circumferentially about one of said bottles more than one-half of the diameter of the body portion of said bottles and on each side of a line perpendicular to and through the longitudinal axes of said bottles, said two band sections of said third of said band areas further extending in a stretched and tensioned condition upwardly over the neck portions of said bottles and being bifurcated to extend on opposite sides of the neck portions of said bottles below the cap portions thereof to a common connection substantially midway between said bottles, and holding means for holding said two band sections at said common connection in a gathered stretched condition and for providing said top central portion of the bag for carrying of the package thereat.

3. A bag for multipackaging two bottles each of which has a body portion and a neck portion tapered to a small diameter cap portion, said bag formed of a resilient elastic plastic sheet material of a thickness such that the material is subject to tearing when the weight of said bottles is supported from a single thickness limited area of the sheet material, said bag comprising three band areas integrally interconnected and arranged to cooperatively permit said bag to be carried by the top central portion of the bag with said two bottles depending therefrom in an upstanding side-by-side relationship in said bag and substantially avoiding any tearing tendency of said bag under the weight load of said bottles, the first of said three band areas comprising an annular band of a circumferential extend capable of encircling the body portions of both of said bottles with said bottles in a firm side-by-side abutting relationship, the second of said three band areas comprising a bottom band of two flaps which extend from opposed lower edges of said annular band and have lengths sufficient to enable the extending ends thereof to be heat sealed together beneath said bottles, the third of said three band areas comprising two band sections connected in opposed relationship to the upper edges of said annular band with each of said band sections having a transverse width greater than one-half of the diameter of the body portion of said bottles, and each of said band sections being bifurcated and of a length permitting a gathering and common connection of the ends of said sections midway between said bottles below the cap portions thereof with said sections in a stretched condition and with the bifurcated portions of said sections on opposite sides of the neck portions of said bottles below said cap portions.

* * * * *